United States Patent [19]

Kolterer

[11] 4,019,458

[45] Apr. 26, 1977

[54] RESIST APPLICATION FOR SELECTIVE PLATING OF ETCHED SHEETS OF PRECISION CHEMICAL MACHINED COMPONENTS

[75] Inventor: Franz Kolterer, Los Altos, Calif.

[73] Assignee: Koltron Corporation, Sunnyvale, Calif.

[22] Filed: Sept. 2, 1976

[21] Appl. No.: 719,902

[52] U.S. Cl. ..... 118/321; 134/172

[51] Int. Cl.[2] ..... B05B 13/04

[58] Field of Search ..... 118/7, 320, 321, 323, 118/326, 416, 613; 134/172, 153

[56] References Cited

UNITED STATES PATENTS

| | | | |
|---|---|---|---|
| 2,976,838 | 3/1961 | Rychlewski et al. | 118/321 |
| 2,977,928 | 4/1961 | Knutsen et al. | 118/321 |
| 3,537,425 | 11/1970 | David et al. | 118/321 X |
| 3,656,493 | 4/1972 | Black et al. | 134/172 X |

*Primary Examiner*—Louis K. Rimrodt
*Attorney, Agent, or Firm*—Boone, Schatzel, Hamrick & Knudsen

[57] ABSTRACT

A photoresist spraying apparatus for coating both sides of metal sheets with photoresist and including a spray gun for spraying photoresist upon a workpiece, a spray chamber having a filter and exhaust vent for containing any overspray; a rack rotatably mounted within the chamber for holding the workpiece to be sprayed; a spray guide disposed at the front of the chamber in front of the workpiece for guiding the spray gun across the workpiece, and a positioning mechanism for moving the spray gun along the guide.

8 Claims, 3 Drawing Figures

RESIST APPLICATION FOR SELECTIVE PLATING OF ETCHED SHEETS OF PRECISION CHEMICAL MACHINED COMPONENTS

BACKGROUND OF THE INVENTION

1. Field of the Invention

The present invention relates generally to apparatus for applying photosensitive resist to precision chemically machined components and more particularly to an apparatus for spraying photoresist on sheets of chemically machined components.

2. Description of the Prior Art

Photoresist has been used extensively in the process of chemically machining precision metal components. The photoresist process is basically a three step process. First, a coating of resist is uniformly applied over a metallic sheet of appropriate thickness. Second, this sheet is sandwiched between a pair of photomasks and exposed to actinic light. Finally, the sheet is developed by an appropriate developing process.

After developing, the non-developed areas of the photoresist are removed by using an appropriate solvent. The sheet is then dried and immersed in a chemical bath. The chemical bath may be either acidic or basic in nature, and attacks those portions of the metallic sheet which are not covered by resist. The developed photoresist serves to ward off the solution and prevent it from attacking those portions of the metallic sheet which are covered.

After the initial etching step, it is usually desirable to selectively plate a second metal over certain portions of the first metal, e.g., gold plating certain portions of integrated circuit lead-frames. In order to accomplish this, a second photoresist application is utilized. Photoresist is applied to the etched metallic sheet; the sheet is sandwiched between photomasks and developed; and the non-developed portions are removed by a suitable solvent as in the etching process. The sheet is then immersed in a metallic plating chamber and plating occurs on those portions of the etched sheet which are not covered by photoresist.

In both photoresist processes described above, it is important that the photoresist be applied evenly and uniformly over the entire surface of the sheet. Moreover, with respect to selective metal plating, it is important that the photoresist cover the etched edges of the sheet as well as the planar portions to prevent plating from occurring where it is not desired. Photoresist has been applied in the past by using roller coating techniques wherein photoresist is rolled across the sheets similar to the method in which paint is applied to household walls.

This method has been found to be unsatisfactory in that the coating realized varies in thickness and coverage and oftentimes results in overcovered or undercovered areas. These coverage variations result in imprecise images and reduce the overall quality of the plated component.

Moreover, roller techniques may not adequately protect the edges formed during the initial etching process which allows plating metals to adhere to the etched edges. This increases the expense of selective plating in that more precious metal plating is used than is necessary.

SUMMARY OF THE PRESENT INVENTION

It is therefore an object of the present invention to provide an apparatus for coating metallic sheets with photoresist so that a uniform overall coating is achieved.

It is another object of the present invention to provide an apparatus for coating previously etched metal sheets with photoresist so that the etched edges, as well as the rest of the sheet, are uniformly coated.

Briefly, a preferred embodiment of a photoresist spraying apparatus in accordance with the present invention includes a spray gun having a reservoir and an air compressor for atomizing and spraying liquid photoresist upon a metallic sheet, a spray chamber having a filter for trapping overspray and a fan and vent for creating an air flow through the filter, a rack for holding the metallic sheet, the rack is rotatably mounted within the spray chamber so that it may be rotated to expose both sides of the metallic sheet to the spray gun, a spray guide located at the front of the spray chamber in front of the rack to guide the spray gun across the metallic sheet, and a positioning mechanism for moving the spray gun across the guide at a constant speed so that a uniform coating of photoresist is applied.

An advantage of the present invention is that photoresist can be applied to metal sheets in a uniform thickness, continuous coating.

Another advantage of the present invention is that previously etched sheets can be uniformly coated with photoresist, including etched edges and corners.

IN THE DRAWING

DETAILED DESCRIPTION OF THE PREFERRED EMBODIMENT

Figure 1:
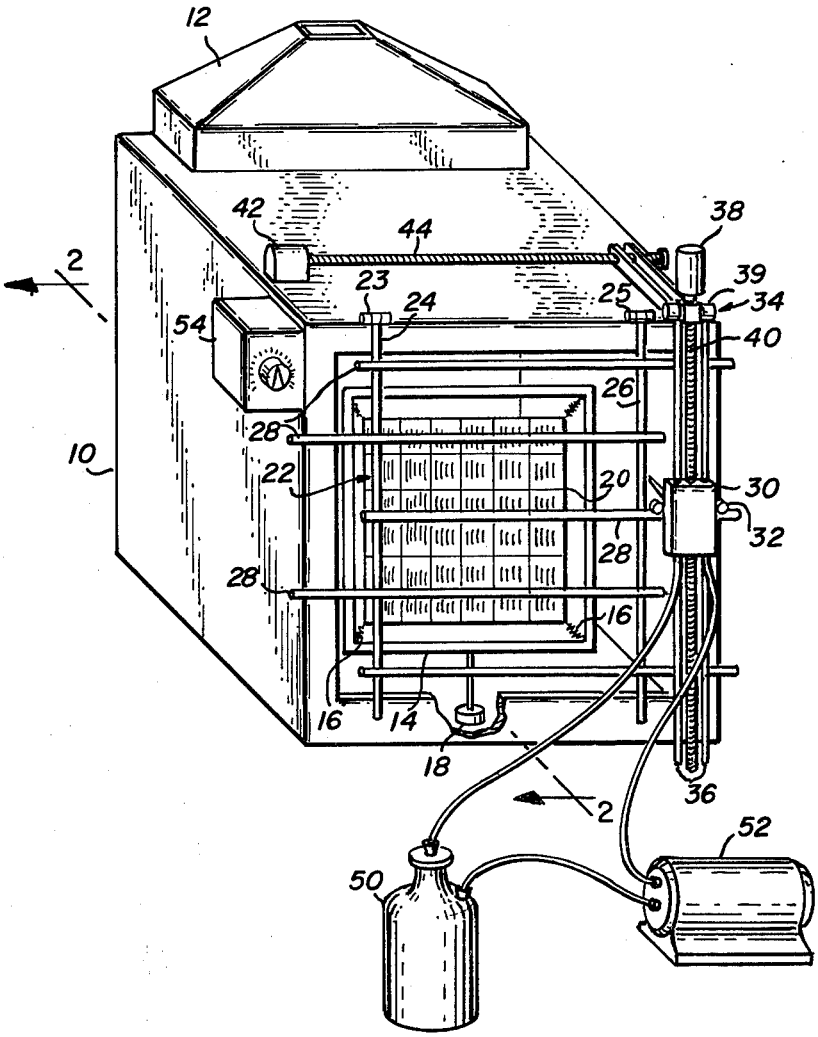
FIG. 1 is an isometric view generally illustrating an apparatus in accordance with the present invention.

Referring now to FIG. 1 of the drawing, an apparatus in accordance with the preferred embodiment of the present invention is shown which includes a spray chamber 10 having an exhaust vent 12 toward the rear of chamber 10; a rack 14 having attachment springs 16 and a revolving mount 18 mounted near the front opening of chamber 10; a workpiece 20 mounted within rack 14; a spray guide 22 having a pair of vertical rods 24 and 26 attached to the top front of chamber 10, and a pluality of staggered spaced horizontal rods 28; a spray gun 30 attached to a set of rollers 32 which are adapted to ride across rods 28; a guide mechanism 34 having a pair of guide rods 36 connected to gun 30, a vertical displacement motor 38, a vertical displacement lead screw 40 connected to motor 38, a horizontal displacement motor 42, and a horizontal displacement lead screw 44 connected to motor 42; a photoresist reservoir 50 connected by flexible tubing to gun 30 for containing liquid photoresist; an air compressor 52 connected by flexible tubing to reservoir 50 and gun 30, and a motor speed control 54 for controlling the direction and speed of motors 38 and 42.

Chamber 10 is of a general box-like construction and may be made of sheet metal or other suitable material to contain the overspray from spray gun 30. Overspray is further prevented from escaping chamber 10 by an exhaust fan (see FIG. 2) mounted within vent 12 which causes an air current to develop which draws the overspray from gun 30 into a filter (see FIG. 2) at the rear of chamber 10.

Rack 14 is of a genrally square construction and is designed to be larger than the sheets 20 which are to be sprayed. Springs, clips or other suitable attachments 16 are used to hold sheet 20 inside rack 14. Mount 18 allows rack 14 to be rotated so that first one side of sheet 20 can be sprayed and then the other side without removing sheet 20 from rack 14.

Guide 22 is mounted to chamber 10 by hinges 23 and 25, so that guide 22 can swing away from the front of chamber 10 to allow rack 14 to rotate. Guide 22 includes a plurality of horizontal stagger space bars 28 which provide the surface upon which rollers 32 ride.

Spray gun 30, mounted to rollers 32, is also slideably mounted to guide bars 36 and vertical lead screw 40. Guide bars 36 are in turn mounted to lead screw 44 through a hinge 39. Lead screw 44 is attached to motor 42 so that as motor 42 rotates guide assembly 34 will move in a horizontal direction causing spray gun 30 to move across guide rods 28. After gun 30 moves past an end of a guide rod 28 and rollers 32 lose contact with a guide rod 28, motor 38 is energized to rotate lead screw 40 so as to raise or lower gun 32 to the next guide rod 28. The operation of motors 42 and 38 are controlled by motor control 54.

Attached to spray gun 30 by suitable pressurized hoses are reservoir 50 and air compressor 52. Compressor 52 provides pressurized air to reservoir 50 to force photoresist into gun 30, and also provides pressurized air to gun 30 to atomize the pressurized photoresist and enable it to be sprayed from gun 30.

Thus, as gun 30 makes a succession of horizontal sweeps across the guide bars 28, photoresist is sprayed upon the workpiece 20. When one side has been sprayed, rack 22 is raised, rack 14 is rotated 180°, and the automated process is begun again. Gun 30 makes another succession of sweeps across workpiece 20 applying a photoresist coating to the second side also.

It should be noted that gun 30 is mounted at an angle to the surface of workpiece 20 which is not perpendicular. This relation allows spray photoresist from gun 30 to penetrate within any etched holes or crevices of workpiece 20 so as to coat those etched edges also.

Figure 2:
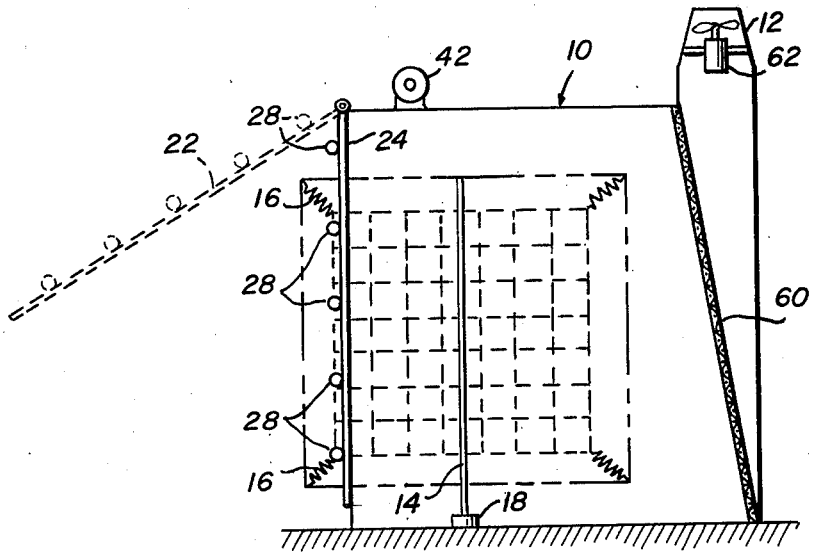
FIG. 2 is a cross-sectional view of the apparatus shown in FIG. 1 taken along the line 2—2.

FIG. 2 illustrates the invention of FIG. 1 in a cross-sectional view taken along the line 2—2. As shown, the preferred embodiment also includes a filter 60 disposed within and at the rear of chamber 10, and an air exhaust fan 62 disposed within vent 12. Fan 62 causes air to flow from the front to the rear of chamber 10, through filter 60 and out vent 12. Thus, overspray from gun 32 is carried into filter 60 where it is trapped and prevented from drifting outside of chamber 10.

Also illustrated in FIG. 2, by broken lines, is the manner in which guide 22 may be lifted vertically to allow rack 14 to rotate. When it is desirable to coat both sides of the workpiece with photoresist, the workpiece is secured to rack 14 by attachments 16, and one side is sprayed with photoresist as previously described. After one side is coated, spray guide 22 is raised which allows rack 14 to be rotated on mount 18 (also shown in broken lines). When rack 14 is rotated 180°, guide 22 is lowered. The second side of the workpiece is then exposed to the spray apparatus and is sprayed with photoresist in the smae manner that the first side was sprayed. Thus, both sides of the workpiece may be coated without removing the piece from rack 14 or effecting the wet surface which had previously been sprayed.

Figure 3:
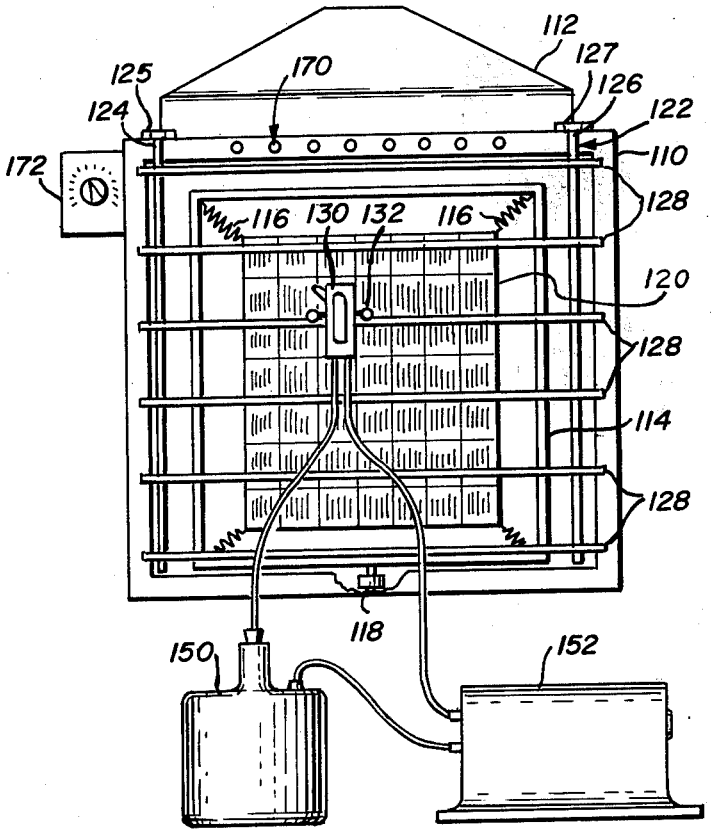
FIG. 3 is an alternative embodiment of the apparatus depicted in FIG. 1 adapted for manual operation.

Turning now to FIG. 3, an alternative embodiment of the present invention which is adapted for manual operation is illustrated. This embodiment includes a chamber 110 having an exhaust vent 112; a rack 114 having attachment springs, clips or other attachment means 116, and being rotatably mounted within chamber 110 by a mount 118; a workpiece 120 mounted within rack 114; a spray guide 122 having a vertical rod 124 mounted to chamber 110 by a hinge 125, a vertical rod 126 mounted to chamber 110 by a hinge 127, and a plurality of horizontal evenly spaced bars 128. It should be noticed that in contrast with the previous embodiment, bars 128 are not staggered. The apparatus also includes a manually operated spray gun 130 having rollers 132, a photoresist reservoir 150, an air compressor 152 for providing pressurized photoresist and pressurized air to spray gun 130; a series of sequential lights 170 mounted across the top of chamber 110, and a light speed control 172.

In this embodiment, gun 30 is moved manually across each of the rods 128 in succession. The speed at which gun 130 is moved is determined by the sequence in which lights 170 are illuminated. Control 172 causes lights 170 to be illuminated in sequence at a predetermined rate in accordance with the spray setting of gun 130, e.g., the heavier the spray from gun 130, the faster the lights 170 will be illuminated, and vice versa. The operator of gun 130 sprays workpiece 120 by moving gun 130 across each bar 128, from the top bar to the bottom bar, following the sequential illumination of lights 170. After one side of workpiece 120 is coated, guide 122 is raised and rack 114 rotated to expose the second side of piece 120, as in the previous embodiment. In this manner, a uniform coating of photoresist may be applied to workpiece 120 by manual operation.

Whereas the present invention has been illustrated and described above in terms of a single preferred embodiment, it is to be understood that numerous alterations and modifications will be apparent to those skilled in the art after having read the preceding disclosure. Accordingly, it is intended that the following claims be interpreted as covering all such alterations and modifications as fall within the true spirit and scope of the invention.

What is claimed is:

1. A photoresist spraying apparatus for spray coating both sides of an etched metal sheet with light-sensitive photoresist comprising:

chamber means including a front wall having an opening, and a rear wall, said chamber means also including vent means located proximate said rear wall;

filter means for trapping excess photoresist spray, said filter means located inside said chamber means proximate said vent means and between said front wall and said vent means;

rack means for holding the metal sheet, said rack means being rotatably mounted inside said chamber means proximate said opening so as to be able to rotate 360°;

spray means for atomizing and spraying liquid photoresist;

guide means for guiding said spray means along a predetermined path, said guide means being hingedly attached to said front wall proximate said rack means; and positioning means for moving said spray means along said guide means whereby said spray means sprays photoresist upon said metal sheet as said spray means moves along said guide means and whereby air flow caused by said vent means draws excess spray into said filter means.

2. A photoresist spraying apparatus as recited in claim 1 wherein said vent means includes fan means for causing air flow.

3. A photoresist spraying apparatus as recited in claim 1 wherein said rack means includes:

a frame for enclosing said metal sheet; and attachment means for attaching said metal sheet to said frame.

4. A photoresist spraying apparatus as recited in claim 1 wherein said spray means includes:

reservoir means for containing liquid photoresist;

a spray nozzle;

line means for connecting said reservoir means to said spray nozzle; and compressor means for providing pressurized air to said reservoir means and said spray nozzle whereby said liquid photoresist is forced into said spray nozzle, atomized and ejected.

5. A photoresist spraying apparatus as recited in claim 1 wherein said guide means includes a plurality of equally spaced apart parallel bars of equal length, each one of said bars being staggered relative to the most nearly adjacent bar.

6. A photoresist apraying apparatus as recited in claim 5 wherein said positioning means includes:

a first screw detent engaged with said spray means;

a plurality of alignment rods slideably engaged with said spray means to prevent said spray means from rotating;

a second screw detent engaged with said alignment rods;

first rotating means for rotating said frist screw detent so as to move said spray means from one of said plurality of equally spaced apart parallel bars to another; and second rotating means for rotating said second screw detent so as to move said alignment bars and said spray means along each of said plurality of equally spaced apart parallel bars.

7. A photoresist spraying apparatus as recited in claim 1 and further comprising control means for controlling the speed at which said positioning means moves said spray means, and for controlling the thickness of the photoresist spray from said spray means.

8. A photoresist spraying apparatus as recited in claim 7 wherein said control means includes a plurality of lights located proximate said guide means, said lights being sequentially illuminated as an indication of the desired movement of said spray means along said guide means.

* * * * *